US005927486A

United States Patent [19]

Kamiya

[11] Patent Number: 5,927,486

[45] Date of Patent: Jul. 27, 1999

[54] ROTARY SWITCH AND TESTER ASSEMBLY INCLUDING CLICK MECHANISM

[75] Inventor: Manabu Kamiya, Nagano, Japan

[73] Assignee: Seiko Epson Corporation, Tokyo, Japan

[21] Appl. No.: 09/021,809

[22] Filed: Feb. 11, 1998

[30] Foreign Application Priority Data

Feb. 25, 1997 [JP] Japan ..... 9-057036

[51] Int. Cl.[6] ..... H01H 21/50; H01H 19/58

[52] U.S. Cl. ..... 200/565; 200/11 R; 200/11 G

[58] Field of Search ..... 200/11 R, 11 A, 200/11 D, 11 DA, 11 G, 11 EA, 11 J, 11 K, 11 TW, 564–569; 324/110, 156

[56] References Cited

U.S. PATENT DOCUMENTS

| | | | |
|---|---|---|---|
| 3,300,594 | 1/1967 | Paine et al. | 200/11 G X |
| 3,632,916 | 1/1972 | Schaad | 200/43.03 |
| 3,736,390 | 5/1973 | Lockard | 200/11 DA |
| 3,961,145 | 6/1976 | Halbeck | 200/11 A X |
| 4,082,925 | 4/1978 | Hufford | 200/11 G |
| 4,243,853 | 1/1981 | Turner | 200/11 R X |
| 4,861,951 | 8/1989 | Olson | 200/11 DA |
| 4,876,416 | 10/1989 | Frantz et al. | 200/11 R |
| 4,945,195 | 7/1990 | Ipcinski | 200/11 R X |
| 5,243,275 | 9/1993 | Nakazawa et al. | 324/110 |
| 5,625,286 | 4/1997 | Kamiya | 324/156 |

FOREIGN PATENT DOCUMENTS

U-7-20824 4/1995 Japan .

*Primary Examiner*—J. R. Scott
*Attorney, Agent, or Firm*—Oliff & Berridge, PLC

[57] ABSTRACT

A rotary switch device and a tester incorporating the rotary switch device are provided. A dial is rotatably mounted in a casing. Brushes are provided for rotation about a rotation axis of the dial as the dial is rotated. Electrical contacts are brought into sliding contact with the brushes by rotation of the brushes. A click mechanism controls rotation of the dial in a clicking manner. The click mechanism has a waved-surface portion formed in one of the dial and the casing and arranged in a manner concentric with the dial, and at least one click spring portion formed in another of the dial and the casing, for clicking engagement with the waved-surface portion. The at least one click spring portion has a support portion protruding axially of the dial from a base surface of the one of the dial and the casing, and at least one spring portion extending from the support portion along the base surface in a manner concentric with the dial.

12 Claims, 3 Drawing Sheets

ROTARY SWITCH AND TESTER ASSEMBLY INCLUDING CLICK MECHANISM

BACKGROUND OF THE INVENTION

1. Field of the Invention

This invention relates to a rotary switch device mounted e.g. in a tester (circuit tester) or the like as a range-switching device thereof and a tester incorporating the rotary switch device.

2. Prior Art

Conventionally, a rotary switch of the above-mentioned kind has been proposed e.g. by the present assignee in Japanese Utility Model Publication (Kokoku) No. 7-20824, in which a click mechanism is formed between a rotor having brushes mounted on its underside and a casing having the rotor fitted therein, while the rotor has its shaft rotatably fitted in a circuit board formed with electrical contacts, for being rotated by a dial, not shown in the publication, arranged on the top of the rotor. The click mechanism is constituted by a waved-surface portion constructed by crests and roots continuously formed along an inner peripheral surface of a circular opening of the casing and a click spring portion formed in a disk-shaped body of the rotor. When the dial covering the rotor is rotated, the click spring portion is rotated for clicking engagement with the waved-surface portion of the casing. The click spring portion is comprised of a pair of spring portions which mainly act as the springs and circular detent portions formed on ends of the respective spring portions. The click spring portion is formed by cutting the disk-shaped body of the rotor such that a portion having a generally crescent shape in plan view is removed therefrom.

The proposed rotary switch device having the above construction, however, has the problem that since the click spring portion is formed in a manner such that part of the disk-shaped body of the rotor is axially cut out to form a space which is crescent-shaped in plan view, a portion of the underside of the rotor for mounting the brushes becomes narrow. Inversely, if a large area is secured for the portion for mounting the brushes, the diameter of the rotor is required to be increased and hence the diameter of the dial covering the rotor is required to be made larger than required. Further, to impart the click spring portion a suitable spring force and at the same time prevent the same from having a useless or undesired twist, it is required that the click spring portion has a predetermined thickness, which results in an undesired increase in the thickness of the rotor per se and hence an undesired increase in the thickness of the whole rotary switch device.

SUMMARY OF THE INVENTION

It is a first object of the invention to provide a rotary switch device which is capable of securing sufficient space for mounting brushes and the like thereon, with a generally thin construction.

It is a second object of the invention to provide a tester incorporating a rotary switch device which is capable of securing sufficient space for mounting brushes and the like thereon, with a generally thin construction.

To attain the first object, according to a first aspect of the invention, there is provided a rotary switch device comprising:

a casing:

a dial rotatably mounted in the casing;

brushes for rotation about a rotation axis of the dial as the dial is rotated;

electrical contacts for being brought into sliding contact with the brushes by rotation of the brushes; and a click mechanism for controlling rotation of the dial in a clicking manner, the click mechanism having a waved-surface portion formed in one of the dial and the casing and arranged in a manner concentric with the dial, and at least one click spring portion formed in another of the dial and the casing, for clicking engagement with the waved-surface portion;

the at least one click spring portion having a support portion protruding axially of the dial from a base surface of the one of the dial and the casing, and at least one spring portion extending from the support portion along the base surface in a manner concentric with the dial.

According to this rotary switch device, when the dial is rotated in a clicking manner with respect to the casing, the brushes are rotated about the rotation axis of the dial as the dial is rotated, and brought into sliding contact with the electrical contacts. The at least one click spring portion for clicking engagement with the waved-surface portion is each constructed by a support portion protruding axially of the dial from the base surface, and at least one spring portion extending from the support portion along the base surface in a manner concentric with the dial, in other words at least one spring portion each formed in a state floated or separate axially of the dial from the base surface. Accordingly, each click spring portion can be formed on the base surface so long as a space can be secured which is axially equal in size to the thickness of the click spring portion. As a result, it is possible to provide a sufficient space for mounting component parts, such as brushes, radially within the extent of the base surface, particularly suitably when the at least one click spring portion is formed on the dial, thereby enhancing the freedom of arranging component parts of the rotary switch device. Further, so long as the extent of an axial projection of each click spring portion is not larger than that of an axial projection of the brushes, the thickness of the rotary switch device is not adversely affected by provision of the at least one click spring portion, and the brushes can be mounted on the base surface, whereby the rotary switch device can be made thin. It should be noted that when the at least one click spring portion is arranged on the dial, it is preferred that the base surface is formed by the underside surface of the dial, whereas when the at least one click spring portion is arranged on the casing, it is preferred that the base surface is formed by an inner surface (underside) of the casing.

Preferably, the base surface is formed by an underside surface of the dial.

According to this preferred embodiment, since the at least one spring portion of each click spring portion is formed in a state floated or separate axially of the dial from the base surface, as described above, it is possible to arrange the at least one click spring portion directly on the underside of the dial without impairing the clicking function thereof. Therefore, the conventional rotor can be dispensed with, whereby the number of component parts of the rotary switch device can be reduced, and the rotary switch device can be made even thinner.

Preferably, the at least one click spring portion is integrally formed on the dial.

According to this preferred embodiment, it is possible to further reduce the number of component parts of the rotary device, whereby the number of man-hours of assemblage and hence cost of manufacturing of the rotary switch device can be reduced.

Preferably, the at least one click spring portion comprises a plurality of click spring portions arranged in a manner concentric with the dial such that spring forces of the click spring portions cancel each other.

According to this preferred embodiment, since the reaction forces of spring forces of the click spring portions applied to the waved-surface portion are cancel each other, the reaction forces of the spring forces are not applied to a shaft of the dial or the like. This makes it possible to smoothly rotate the dial to thereby smoothly bring the brushes into sliding contact with the electrical contacts.

Further preferably, the at least one click spring portion is formed as an annular protruding portion on the underside surface of the dial.

Even more preferably, the plurality of click spring portions are formed as respective separate protruding portions formed on the underside surface of the dial to form a generally annular protruding portion.

Even further preferably, each of the separate protruding portions has opposite ends, the at least one spring portion comprises opposite spring portions of each of the click spring portions which is formed by cutting out a root portion of the each of the separate protruding portions from each of the opposite ends thereof in a manner such that a wedge-shape portion is removed therefrom.

Still more preferably, the opposite spring portions of the each of the click spring portions is formed with a convex portion at an end thereof, for engagement with one of root portions of the waved-surface portion.

To attain the second object, according to a second aspect of the invention, there is provided a tester including a rotary switch device as a measuring mode-switching device, the rotary switch device comprising:

a casing;

a dial rotatably mounted in the casing;

brushes for rotation about a rotation axis of the dial as the dial is rotated;

electrical contacts for being brought into sliding contact with the brushes; and a click mechanism for controlling rotation of the dial in a clicking manner, the click mechanism having a waved-surface portion formed in one of the dial and the casing and arranged in a manner concentric with the dial, and at least one click spring portion formed in another of the dial and the casing, for clicking engagement with the waved-surface portion;

the at least one click spring portion having a support portion protruding axially of the dial from a base surface of the one of the dial and the casing, and spring portions extending from the support portion along the base surface in a manner concentric with the dial.

According to this tester, it is possible to design a main unit of a tester compact in size.

The above and other objects, features, and advantages of the invention will become more apparent from the following detailed description taken in conjunction with the accompanying drawings.

DETAILED DESCRIPTION

The invention will now be described in detail with reference to drawings showing an embodiment thereof.

Figure 1:
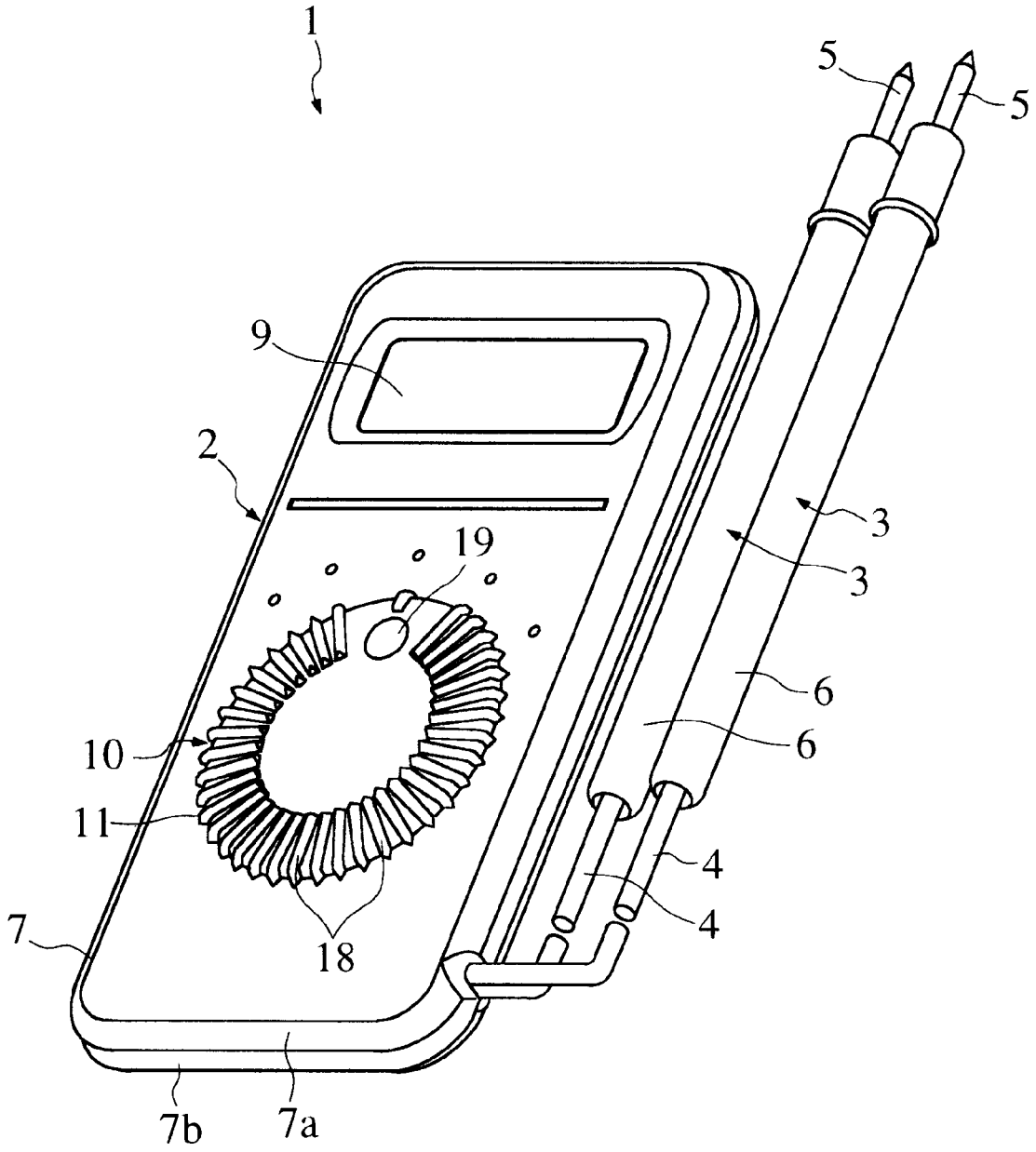
FIG. 1 is a perspective view of an appearance of a tester incorporating a rotary switch device according to an embodiment of the invention.

Referring first to FIG. 1, there is shown a tester (circuit tester) incorporating a rotary switch device according to an embodiment of the invention. The tester is of a digital type which displays results of measurements in numerical values. FIG. 1 is a perspective view of an appearance of the tester. As shown in the figure, the tester 1 is comprised of a main unit 2, and a pair of plus and minus test probes 3, 3 connected to the main unit 2.

Each test probe 3 is comprised of a lead wire 4 connected to the main unit 2, a probe 5 connected to a distal end of the lead wire 4, and a grip 6 in the form of a hollow cylinder which supports the probe 5 and at the same time covers a portion connecting between the probe 5 and the lead wire 4. The user holds the grips 6 of the test probes 3 by his hands, respectively, in such a manner as holding pencils, and bring the tips of the probes 5 into contact with a measuring object. The probe 5 and the lead wire 4 are connected by a crimp contact, not shown.

Figure 2:
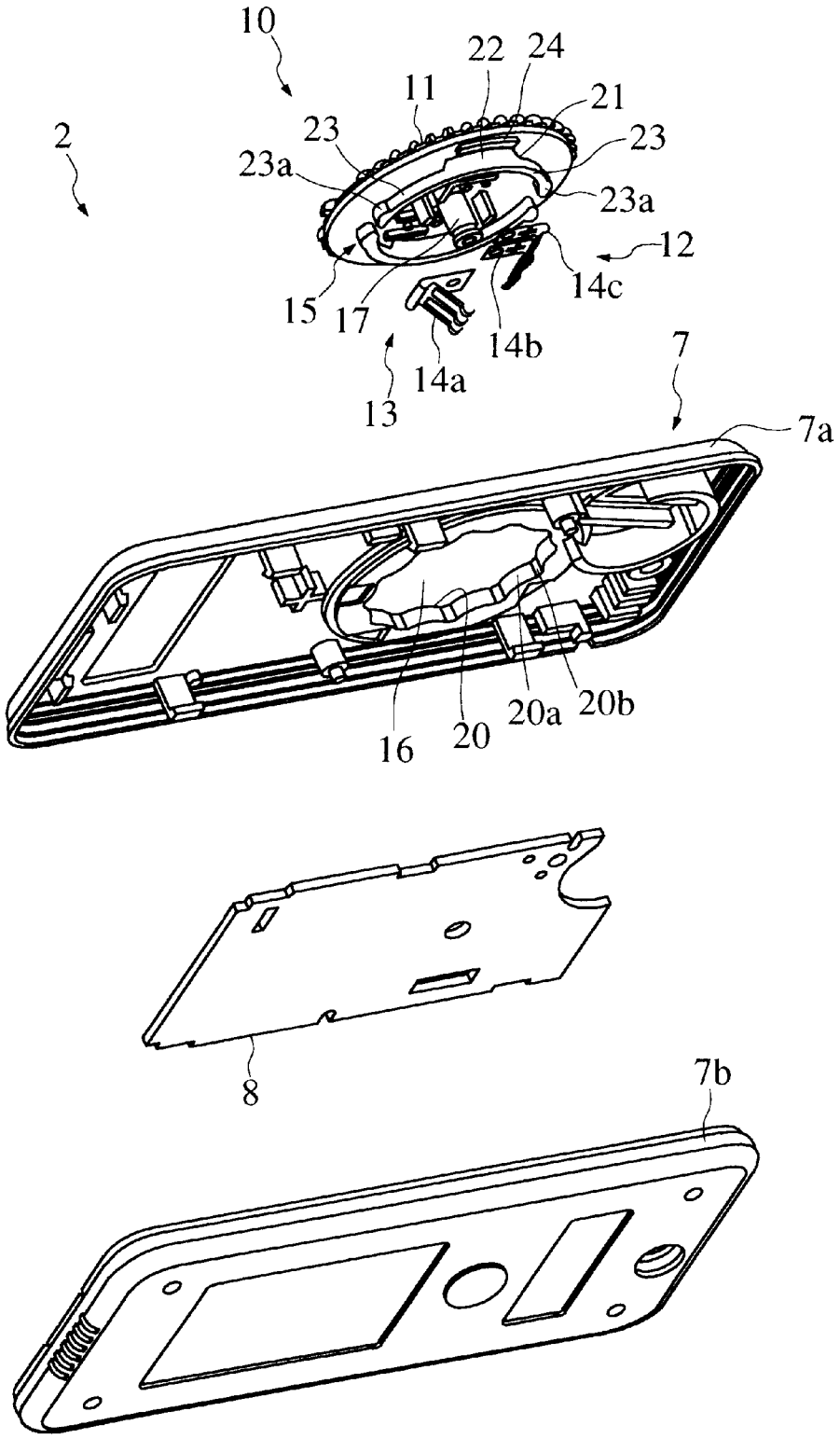
FIG. 2 is an exploded perspective view of the rotary switch device according to the embodiment and component parts associated therewith.

The main unit 2 is comprised of a casing 7 formed by an upper casing 7*a* and a lower casing 7*b*, which accommodates component parts including a circuit board 8 (see FIG. 2). At an approximately central portion of the top of the upper casing 7*a*, there is arranged a dial 11 for switching between measuring modes. At a location upward of the dial 11 as viewed in FIG. 1, there is arranged a display 9 for digitally displaying measured values. The dial 11 forms a component part of a rotary switch device 10 for switching between measuring modes of the tester 1. The rotary switch device 10 is comprised of the dial 11, a click mechanism 12 for rotating the dial in a clicking manner, and a switch 13 formed of brushes 14 and electrical contacts, not shown (see FIG. 2).

As shown in FIG. 2, a circuit board 8 is arranged under the bottom of the dial 11 such that the circuit board 8 and the dial 11 are opposed to each other with a predetermined gap therebetween. The dial 11 has a generally annular protruding portion 15 formed on the bottom or underside surface thereof for being rotatably fitted in a circular opening 16 formed through the upper casing 7*a*, and a shaft 17 integrally formed therewith for being rotatably mounted in the circuit board 8. The top of the dial 11 is formed with a large number of radial linear projections 18 for preventing slippage of the user's fingers when the user turns the dial, and a circular convex portion 19 for indicating a selected measuring mode of the tester 1 (see FIG. 1). Although there are a lot of possible measuring modes adapted to respective measuring objects, the tester of the present embodiment is configured to operate in any of a direct current mode, an alternating current mode, an ohm mode, and a continuity test mode, which can be set by turning the dial 11 from the OFF position at an extremity of counterclockwise rotation of the dial 11 to a selected one of dial positions for the modes provided around the dial 11 from left to right in the mentioned order.

Figure 3:
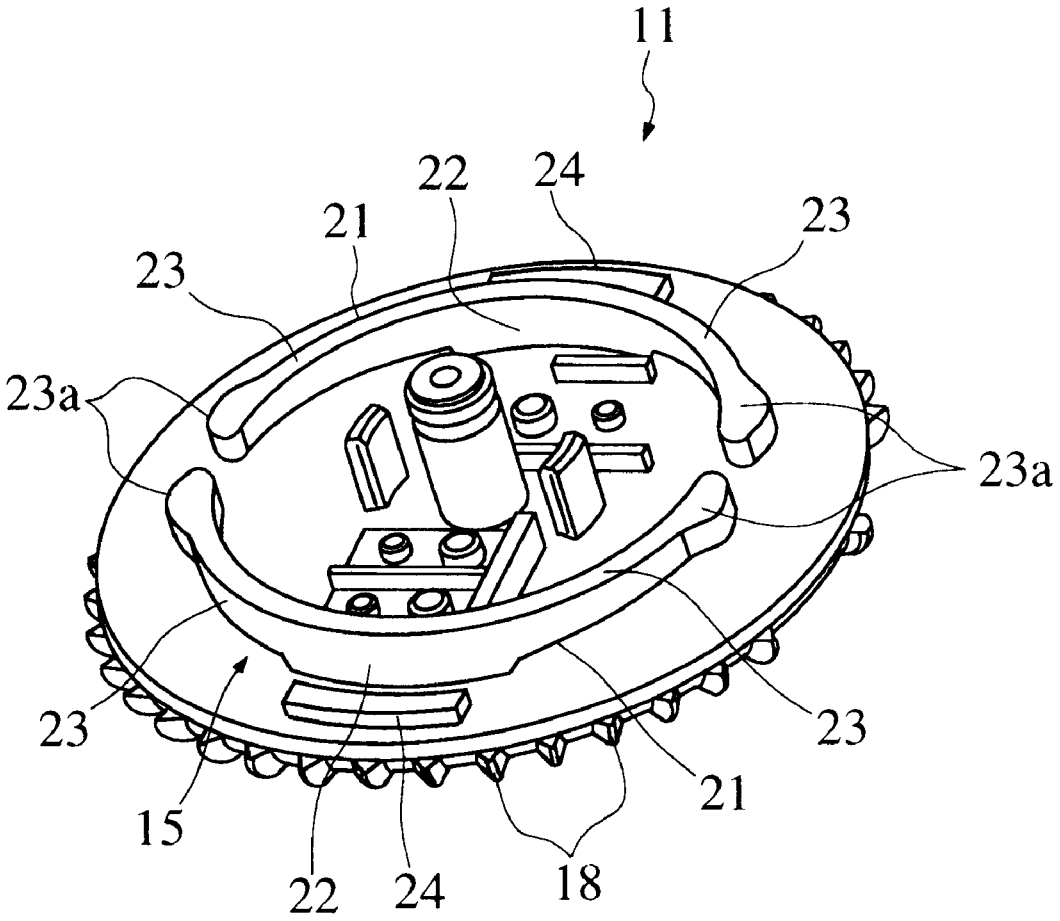
FIG. 3 is a perspective view of a dial of the rotary switch device according to the embodiment, as viewed from a reverse side thereof.

The click mechanism 12 is comprised of a waved-surface portion 20 formed along an inner peripheral surface of the circular opening 16 formed through the upper casing 7*a*, and a pair of click spring portions 21, 21 formed as separate semiannular portions of the annular protruding portion 15 which are brought into clicking engagement with the waved-surface portion 20. The pair of click spring portions 21, 21 each having a generally semianular shape, as shown in FIG. 3, are formed on the bottom or underside surface of the dial 11 such that they project downward therefrom along an imaginary circle concentric with the dial 11 and are opposed to each other. Each click spring portion 21 is comprised of a support portion 22 at a circumferentially intermediate location, and a pair of spring portions 23, 23 extending from the support portion 22 in circumferentially opposite directions along the underside surface of the dial 11. Each spring portion 23 has an end thereof formed with a convex portion 23*a* having a radially outwardly protruding arcuate shape, for clicking engagement with the waved-surface portion 20. Each click spring portion 21 is integrally formed on the dial 11, and the spring portions 23 of each click spring portion 21 are each formed by cutting out a root portion of the semi-annular portion from each of the opposite ends thereof such that a wedge-shaped portion is removed therefrom. That is, although each support portion 22 is fixed to the bottom of the dial 11, each spring portion 23 is floated or movably spaced from the bottom of the dial 11.

On the other hand, the waved-surface portion 20 is constituted by twelve crests 20*a* and twelve roots 20*b* continuously formed along an inner peripheral surface of the circular opening 16. As described above, each of the pair of click spring portions 21, 21 arranged in a manner opposed to each other has spring portions (convex portion 23*a*, 23*a*) 23, 23 on opposite ends thereof and hence the convex portions 23*a*, 23*a*, 23*a*, 23*a* are arranged by twos at diametrically opposite or centrosymmetrical locations. Each pair of two convex portions 23*a*, 23*a* arranged side by side are engaged with two roots 20*b*, 20*b* adjacent to each other, respectively. Therefore, the five detent positions, that is, the OFF position and the other four mode positions described above correspond to six roots 20*b* for engagement of the two convex portions 23*a*, 23*a* (and six crests 20*a*) . The remaining six roots 20*b* (and six crests 20*a*) are for engagement with the other two convex portions 23*a*, 23*a* arranged on an opposite side to the above convex portions 23*a*, 23*a*. To inhibit the dial 11 from rotating beyond the five detent positions, projections 24 are formed on the bottom of the dial 11 at respective locations outside the click spring portions 21, while stoppers, not shown, for abutting against the respective projections 24 are formed on the inner peripheral surface of the opening of the casing 7.

When the dial 11 is rotated, the convex portions 23*a* in engagement with roots 20*b* slide on crests in a manner ascending the slopes thereof. By this sliding of the convex portions 23*a*, the spring portions 23 of each click spring portion 21 are bent inward and react to urge the crests 20*a*. When each convex portion 23*a* slides past a peak of the crest 20*a*, it is brought into engagement with a next root 20*b* by the expansive force of the spring portion 23 in a manner dropping therein. Thus, the dial 11 is rotated in a clicking manner to a selected one of the five detent positions, that is, the OFF position and the other four mode positions.

The switch 13 is comprised of brushes 14 mounted on an area of the bottom of the dial 11 surrounded by the annular protruding portion 15, i.e. the two click spring portions 21, 21, and the electrical contacts, not shown, formed on the top of the circuit board 8. The brushes 14 are comprised of a first brush 14*a* having a large width and including three brush pieces, a second brush 14*b* having a small width and including two brush pieces, and a third brush 14*c* having a small width and including three brush pieces. The second brush 14*b* and the third brush 14*c* are arranged radially adjacent to each other, while the first brush 14*a* is arranged at a location opposite to the second brush 14*b* and the third brush 14*c* with respect to the shaft 17. On the other hand, the electrical contacts, although not particularly shown, are arranged concentrically in a plurality of rows corresponding to the respective kinds of brush pieces of the brushes 14.

As described above, according to the embodiment, each spring portion 23 is formed by cutting out a root portion of each semiannular portion of the annular protruding portion of the annular projection 15, which forms a click spring portion 21, from each of opposite ends of the semiannular portion such that a wedge-shaped portion is removed therefrom. That is, each spring portion 23 is formed such that it axially protrudes from the bottom or underside surface of the dial 11. Therefore, it is possible to secure a sufficient space for arranging the brushes 14 and the like inside the spring portions 23, and at the same time form the click spring portions 21 integrally with the dial 11. As a result, it is possible to increase the space efficiency inside the casing 7, attaining reduction of the number of component parts of the tester and its manufacturing costs. Further, the brushes 14 can be directly mounted on the underside surface of the dial 11, whereby the main unit 2 can have a thin construction.

On the other hand, the space for the brushes 14 is first secured inside the click spring portions 21, 21 and then two pairs of spring portions 23 of the click spring portions 21 are arranged at diametrically opposite or centrosymmetrical locations respectively, so that the spring forces of the two pairs of spring portions 23 cancel each other. Accordingly, the spring forces of the spring portions 23 do not undesirably affect the operation of the dial 11, thereby ensuring smooth rotation of the dial 11, which makes it possible to improve the durability of this portion of the rotary switch device or prolong the service life of the same.

It should be noted that although in the above embodiment the click spring portions are integrally formed on the dial on the bottom or underside thereof, the same may be formed on a rotor as in the conventional rotary switch device, and the rotor may be fixedly engaged with a dial. Further, the click spring portions maybe formed as separate members which are mounted on a dial. On the other hand, although in the embodiment, the click spring portions are formed on the dial, the same may be formed on the casing and at the same time the waved-surface portion may be formed on the dial.

It is further understood by those skilled in the art that the foregoing are preferred embodiments of the invention, and that various changes and modification may be made without departing from the spirit and scope thereof.

What is claimed is:

1. A rotary switch device comprising:

a casing;

a dial rotatably mounted in said casing;

brushes for rotation about a rotation axis of said dial as said dial is rotated;

electrical contacts for being brought into sliding contact with said brushes by rotation of said brushes; and a click mechanism for controlling rotation of said dial in a clicking manner, said click mechanism having a waved-surface portion formed in one of said dial and said casing and arranged in a manner concentric with said dial, and at least one click spring portion formed in another of said dial and said casing, for clicking engagement with said waved-surface portion, said at least one click spring portion having a support portion protruding axially of said dial from a base surface of said one of said dial and said casing, at least one spring portion extending from said support portion along said base surface in a manner concentric with said dial, and said base surface being formed by an underside surface of said dial.

2. A rotary switch device according to claim 1, wherein said at least one click spring portion is integrally formed on said dial.

3. A rotary switch device according to claim 1, wherein said at least one click spring portion comprises a plurality of click spring portions arranged in a manner concentric with said dial such that spring forces of said click spring portions cancel each other.

4. A rotary switch device according to claim 1, wherein said at least one click spring portion comprises a plurality of click spring portions arranged in a manner concentric with said dial such that spring forces of said click spring portions cancel each other.

5. A rotary switch device according to claim 2, wherein said at least one click spring portion comprises a plurality of click spring portions arranged in a manner concentric with said dial such that spring forces of said click spring portions cancel each other.

6. A rotary switch device according to claim 2, wherein said at least one click spring portion is formed as an annular protruding portion on said underside surface of said dial.

7. A rotary switch device according to claim 5, wherein said plurality of click spring portions are formed as respective separate protruding portions formed on said underside surface of said dial to form a generally annular protruding portion.

8. A rotary switch device according to claim 7, wherein each of said separate protruding portions has opposite ends, said at least one spring portion comprises opposite spring portions of each of said click spring portions which is formed by cutting out a root portion of said each of said separate protruding portions from each of said opposite ends thereof in a manner such that a wedge-shape portion is removed therefrom.

9. A rotary switch device according to claim 8, wherein each of said opposite spring portions of said each of said click spring portions is formed with a convex portion at an end thereof, for engagement with one of root portions of said waved-surface portion.

10. A tester including a rotary switch device as a measuring mode-switching device, said rotary switch device comprising:

a casing;

a dial rotatably mounted in said casing;

brushes for rotation about a rotation axis of said dial as said dial is rotated;

electrical contacts for being brought into sliding contact with said brushes by rotation of said brushes; and a click mechanism for controlling rotation of said dial in a clicking manner, said click mechanism having a waved-surface portion formed in one of said dial and said casing and arranged in a manner concentric with said dial, and at least one click spring portion formed in another of said dial and said casing, for clicking engagement with said waved-surface portion, said at least one click spring portion having a support portion protruding axially of said dial from a base surface of said one of said dial and said casing, at least one spring portion extending from said support portion along said base surface in a manner concentric with said dial, and said base surface being formed by an underside surface of said dial.

11. A tester according to claim 10, wherein said at least one click spring portion is integrally formed on said dial.

12. A tester according to claim 10, wherein said at least one click spring portion comprises a plurality of click spring portions arranged in a manner concentric with said dial such that spring forces of said click spring portions cancel each other.

* * * * *